US006080324A

United States Patent [19]

Pleva

[11] Patent Number: 6,080,324

[45] Date of Patent: Jun. 27, 2000

[54] SWIMMING POOL SURGE PIT FILTER

[75] Inventor: Mark G. Pleva, Woodward, Iowa

[73] Assignee: Sentry Valve Co., Inc., Woodward, Iowa

[21] Appl. No.: 09/233,898

[22] Filed: Jan. 20, 1999

[51] Int. Cl.[7] ..... E04H 4/12; E04H 4/16

[52] U.S. Cl. ..... 210/791; 210/805; 210/169; 210/416.2; 4/507; 4/508

[58] Field of Search ..... 210/769, 791, 210/805, 169, 416.2; 4/506, 507, 508

[56] References Cited

U.S. PATENT DOCUMENTS

| | | | |
|---|---|---|---|
| 2,844,255 | 7/1958 | Cavenah et al. . | |
| 2,900,079 | 8/1959 | Pace . | |
| 2,914,180 | 11/1959 | Konopka et al. . | |
| 2,979,206 | 4/1961 | Konopka et al. . | |
| 2,980,256 | 4/1961 | Nash . | |
| 3,080,060 | 3/1963 | Blumenkrantz . | |
| 3,125,513 | 3/1964 | Johnson . | |
| 3,143,499 | 8/1964 | Miller . | |
| 3,677,408 | 7/1972 | Dinizo, Jr. | 210/169 |
| 3,864,262 | 2/1975 | Lang et al. | 210/169 |
| 5,367,723 | 11/1994 | Pleva et al. | 4/508 |

*Primary Examiner*—Robert J. Popovics
*Attorney, Agent, or Firm*—Zarley, McKee, Thomte, Voorhees & Sease

[57] ABSTRACT

An improved filtering device for a swimming pool surge pit is provided. The filtering device includes a frame with first and second filter elements removably mounted in the frame such that water flows through both elements to remove debris before the water enters a water supply line leading to the main filtration system of the pool. The filter elements slide along guide tracks in the frame and are independently removable such that one filter element is always in place. Thus, the water in the surge pit is filtered 100% of the time before passage into the water supply line. The filter elements extend above the water level in the surge pit such that both floating and submerged debris are captured by the filter elements.

11 Claims, 2 Drawing Sheets

SWIMMING POOL SURGE PIT FILTER

BACKGROUND OF THE INVENTION

Swimming pools normally include a filtration system which receives water from the pool, removes debris from the pool, and then returns the filtered water back to the pool. More particularly, a pool typically has a main drain and a gutter system, both of which include drain lines leading to a remote surge pit. Typically, 60–80% of the water in the surge pit comes from the gutter system, and 20–40% of the water in the pit comes from the main drain of the pool.

The filtration system includes a pump which draws water from the surge pit and delivers the water to the main filtration bed. A surge pit filter is also conventional to prevent large debris from being pulled into the filter pump. One example of a prior art surge pit filter is a mesh basket filter which is submerged below the water in the surge pit. However, such a submerged filter will not capture floating debris, which will then decompose in the surge pit. Periodic cleaning of the basket filter is also necessary to remove the collected debris. Such cleaning is achieved by removing the basket from the surge pit, which allows unfiltered water to pass through the pump, leading to potential pump damage.

New government regulations require filtration to occur 100% of the time. A conventional underwater basket filter cannot meet this new regulation, due to the time period it must be removed from the surge pit for cleaning.

Accordingly, a primary objective of the present invention is the provision of an improved filtering device for a swimming pool surge pit.

Another objective of the present invention is the provision of a surge pit filtering device which filters the water 100% of the time.

A further objective of the present invention is the provision of a surge pit filtering device having multiple filter elements which are independently removable for cleaning.

Still another objective of the present invention is the provision of a filtering device for a swimming pool surge pit which is effective in use and easy to clean.

Another objective of the present invention is a method of continuously filtering water in a swimming pool surge pit before the water is pumped from the pit to the primary filter system of the swimming pool.

These and other objectives will become apparent from the following description of the invention.

SUMMARY OF THE INVENTION

The present invention is directed towards a filtering device for a swimming pool surge pit, and a method of continuously filtering the water in the surge pit before pumping to the primary filtering system of the pool. The device includes a frame which is positioned in the surge pit in the path of the water flow to the pump supply line. First and second filter elements are removably mounted within the frame such that the water normally flows through both elements to remove debris before the water enters the supply line. One filter element can be removed for cleaning while the other filter element remains in the frame so as to assure filtration of the water 100% of the time. The frame includes guide tracks to facilitate the removal and insertion of the filter elements. The filter elements are supported by the frame in an inclined orientation, and extend above the water level in the surge pit such that floating debris, as well as submerged debris, is captured by the filter elements. A lip is provided on each of the filter elements to obtain the debris when the filter elements are removed from the frame.

In the method of the present invention, the filter frame is installed in the pit adjacent the filter line. In normal operation, the water passes through both filter elements before entering the filter line. When the filters need cleaning, one filter can be removed from the frame, cleaned, and re-inserted into the frame while the other filter continues to function. Then, the second filter can be removed, cleaned and re-inserted while the first filter continues to function. Thus, continuous filtration is assured.

DESCRIPTION OF THE PREFERRED EMBODIMENT

Figure 1:
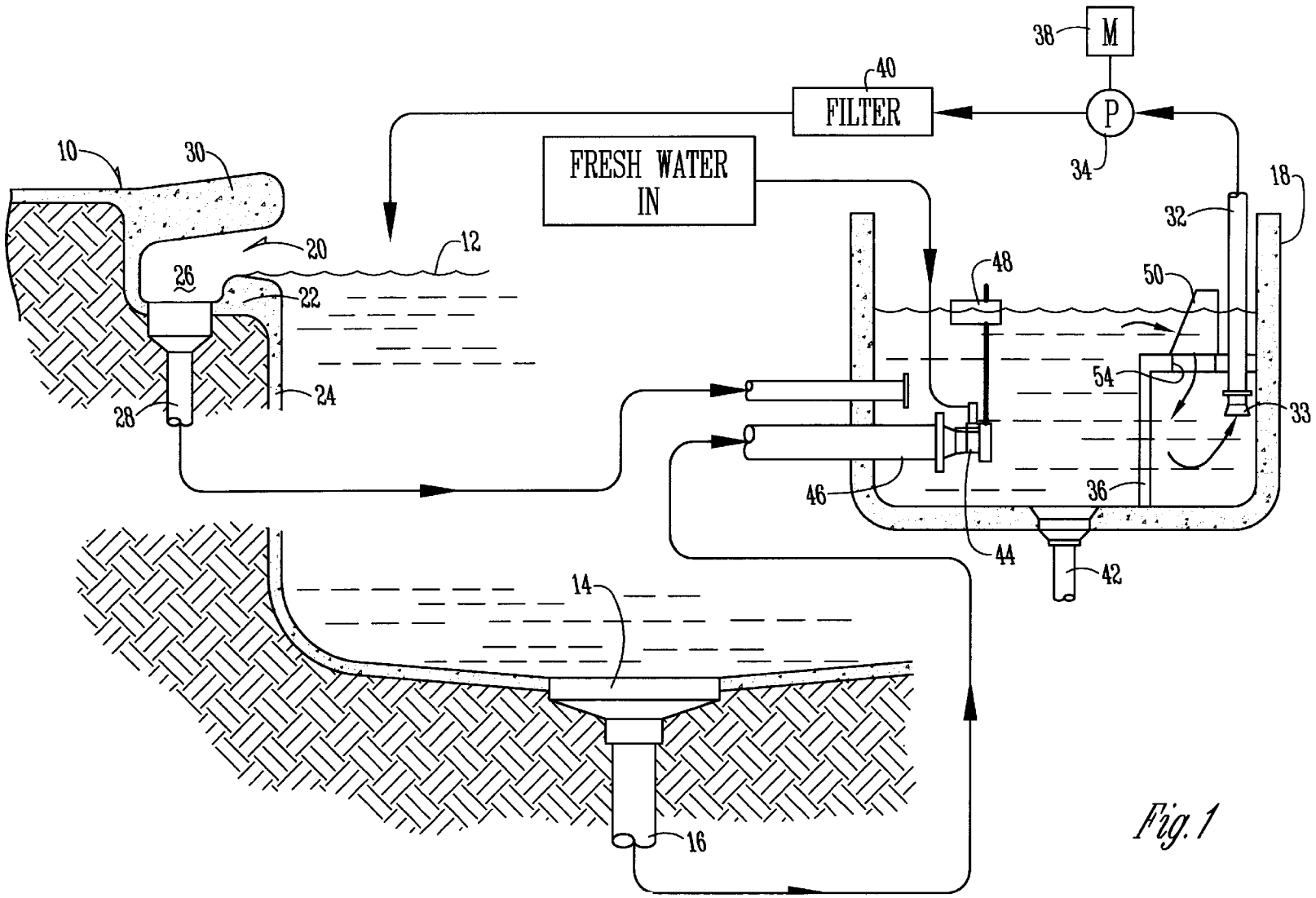
FIG. 1 is a schematic view of the water flow in a swimming pool, including the remote surge pit.
Figure 2:
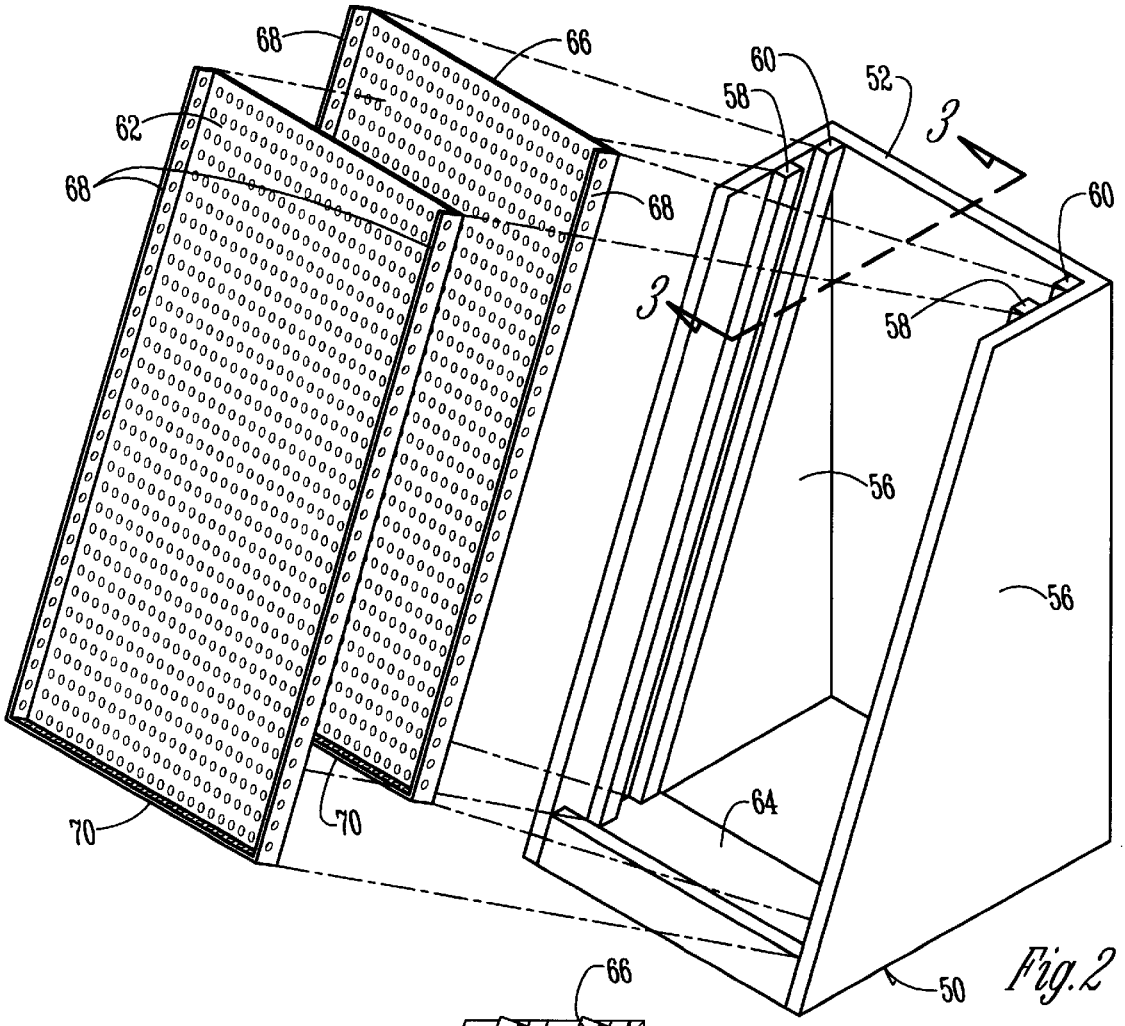
FIG. 2 is an exploded perspective view of the filtering device of the present invention.

In the drawings, a swimming pool is generally designated by the reference numeral 10, and is filled with water 12. A filter house (not shown) contains the mechanical filtration and chlorination equipment for the pool. The pool 10 includes a main drain 14 in the deepest portion of the pool. The main drain 14 includes a drain line 16 leading to a reservoir or surge pit 18 in the filter house. The pool also includes a perimeter gutter system 20 extending around the pool. The gutter 20 includes a lip 22 adjacent the side wall 24 of the pool and a recessed gutter cavity 26. A gutter drain line 28 leads from the gutter cavity 26 to the surge pit 18. The deck 30 of the pool extends over the gutter cavity 26.

The surge pit 18 holds water draining from the main drain 14 and the gutter system 20. The surge pit 18 includes a water supply line 32 leading to a pump 34 housed within the filter house. The inlet end 33 of the supply line 32 extends into an enclosure 36 in a portion of the surge pit 18, as shown in FIG. 1. A motor 38 actuates the pump 34. The pump 34 is on the supply side of the main pool filtration system 40. The surge pit 18 also includes a drainage line 42 for draining the water from the pit.

The above description of the pool structure, including the surge pit 18, is conventional and does not form a part of the present invention.

A valve assembly 44 is provided on the outlet end of the drain line 16, and is controlled by a float 48. The structure and operation of the valve assembly 44 is described in applicant's U.S. Pat. No. 5,367,723, and is incorporated herein by reference.

The present invention is directed towards a filtering device 50 for the surge pit 18 to filter the water before entry into the supply line 32. More particularly, the filter device 50 includes a frame 52 which sits upon or is secured to the enclosure 36. The bottom of the frame 52 is open and aligns with an opening 54 in the enclosure 36. The frame 52 includes opposite sides 56. A first set of guide tracks 58 and a second set of guide tracks 60 are provided on the opposites 56 of the frame 52.

A first filter element 62 is adapted to slide along the first guide tracks 58 between the sides 56 of the frame 52 and rest upon a lower support 64 on the frame 52. A second filter element 66 is adapted to slide along the second guide tracks 60 and rest along the lower support 64. Thus, the first and second filter elements 62, 64 can be independently removed from and inserted into the frame 52. Preferably, the filter elements 62, 66 are constructed of perforated PVC, so as to be lightweight and easily cleanable. Alternatively, the filter elements 62, 66 may be a wire mesh, or any other suitable filter media.

Figure 3:
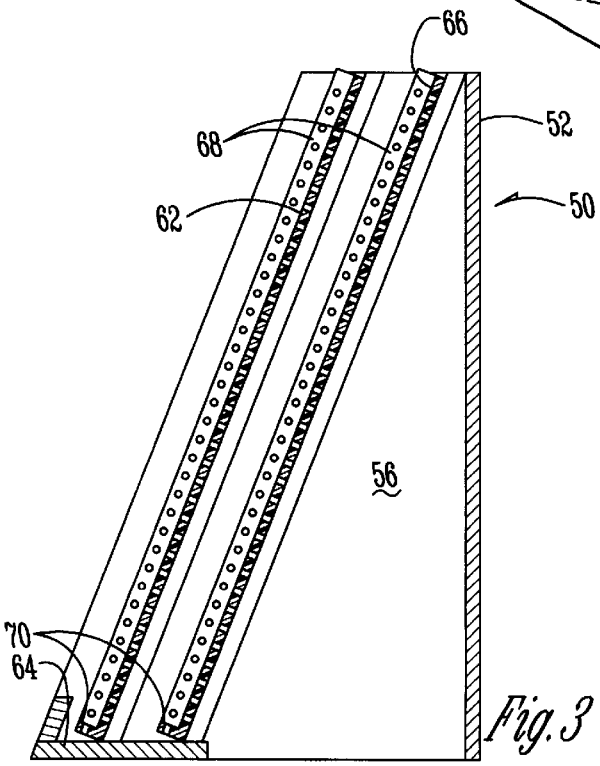
FIG. 3 is a sectional view of the filtering device taken along lines 3—3 of FIG. 2.

As best seen in FIG. 3, the filter elements 62, 66 are positioned in an inclined orientation so as to extend above the water level in the surge pit 18, while allowing the water to pass downwardly through the filter device 50. Each filter element 62, 66 includes upturned side lips 68 and an upturned bottom lip 70, which facilitate retention of debris on the filter element when removed from the frame 52.

In operation, water from the main drain 14 and from the gutter system 20 of the pool 10 is supplied through the drain lines 16, 28 to the surge pit 18. The surge pit drain line 42 is normally closed. Upon actuation of the pump 34, the water in the pit 18 is pulled through the first filter element 62 and the second filter element 66 and then through the opening 54 in the enclosure 36 for entry into the water supply line 32. The water is then pumped to the main filtration system 40 and then back to the pool 10. The filter elements 62, 66 of the filter device 50 extend above and below the water level in the surge pit 18, thereby capturing both floating debris and submerged debris before the water enters the supply line 32.

Periodically, the filter elements 62,66 will need to be cleaned. One of the filter elements 62, 66 can be quickly and easily removed from the frame 52 by pulling upwardly for sliding movement along the respective guide tracks 58,60, while the other filter element remains in position for continuous filtering. After the removed filter element is cleaned, it is installed back into the frame 52, and the other element can be removed for cleaning. Thus, the water in the surge pit is filtered 100% of the time before passage into the inlet end 33 of the water supply line 32. Accordingly, the filter device 50 prevents debris from being drawn into the supply line 32, thereby preventing damage to the pump 34.

Whereas the invention has been shown and described in connection with the preferred embodiment thereof, it will be understood that many modifications, substitutions, and additions may be made which are within the intended broad scope of the following claims. From the foregoing, it can be seen that the present invention accomplishes at least all of the stated objectives.

What is claimed is:

1. A filtering device for a swimming pool having a remote surge pit to receive water from the pool, with a water supply line adapted to provide waters from the pit to a primary filter system, the device comprising:

a frame mounted in the surge pit;

first and second filter elements removably mounted in the frame such that water flows through both elements to remove debris before the water enters the supply line.

2. The filter device of claim 1 wherein the filter elements are in an inclined orientation in the frame.

3. The filter device of claim 1 wherein the frame includes guide tracks to facilitate the removal and insertion of the filter elements in the frame.

4. The filter device of claim 1 wherein each of the filter elements is perforated.

5. The filter device of claim 4 wherein the perforations of the second filter element are finer than the perforations in the first filter element.

6. The filter device of claim 1 wherein the first and second filter elements are independently removable from the frame.

7. The filter device of claim 1 wherein the filter elements are in an upright position so as to extend above the water in the pit.

8. The filter device of claim 1 wherein each filter element includes a lip to retain debris as the filter element is removed from the frame.

9. The filter device of claim 1 wherein the filter elements are perforated PVC material.

10. A method of continuously filtering water in a swimming pool surge pit before the water is pumped into a filter line from the pit, the method comprising:

installing a filter frame in the pit adjacent the filter line, the frame having two removable filters, normally passing waters through both filters before entry into the filter line;

removing one of the filters from the frame for cleaning while the water continues to pass through the other filter such that the water is continuously filtered 100% of the time before being pumped from the pit.

11. The method of claim 10 further comprising inserting the one removed filter back into the frame and then removing the other filter from the frame for cleaning.

* * * * *